United States Patent [19]

Wallgard et al.

[11] 4,023,754

[45] May 17, 1977

[54] FAIL-SAFE SEPARATION OF DRIVERLESS VEHICLES

[75] Inventors: Gunnar A. Wallgard, Huskvarna; Sven-Arne Gustafsson, Taberg, both of Sweden

[73] Assignee: Saab-Scania Aktiebolag, Linkoping, Sweden

[22] Filed: Mar. 26, 1976

[21] Appl. No.: 670,755

[30] Foreign Application Priority Data

Apr. 1, 1975 Sweden ..... 7503672

[52] U.S. Cl. ..... 246/63 R; 246/167 R; 246/178; 246/187 B

[51] Int. Cl.[2] ..... B61L 21/06

[58] Field of Search ..... 246/28 R, 63 R, 63 A, 246/63 C, 187 B, 187 C, 167 R, 177, 178; 235/150.2, 150.24

[56] References Cited

UNITED STATES PATENTS

| | | | |
|---|---|---|---|
| 2,803,743 | 8/1957 | Ballerait | 246/63 R |
| 3,848,836 | 11/1974 | Wallgard | 246/63 R |

*Primary Examiner*—Trygve M. Blix

*Assistant Examiner*—Reinhard J. Eisenzopf

*Attorney, Agent, or Firm*—Ira Milton Jones & Associates

[57] ABSTRACT

Driverless vehicles, confined to motion in one direction along a defined path divided into blocks, receive commands from a central unit in the form of encoded command signals radiated from an elongated radiator. Each vehicle progresses only while receiving signals regularly. The radiator comprises two parallel stretches, each extending all along the path but divided into sections, each section being as long as a block but extending across a block boundary, with a section of each stretch paired with a laterally adjacent section of the other stretch. In each section pair, the segment of one section that lies in one block is shielded, the remainder unshielded; the other section of the pair has opposite shielded and unshielded segments. Bistable switching devices, controlled by vehicle responsive detectors at each block boundary, switch signal current between the two sections of each pair in such a manner as to prevent a vehicle from entering an occupied block while providing for signal current flow along the full length of the radiator.

5 Claims, 1 Drawing Figure

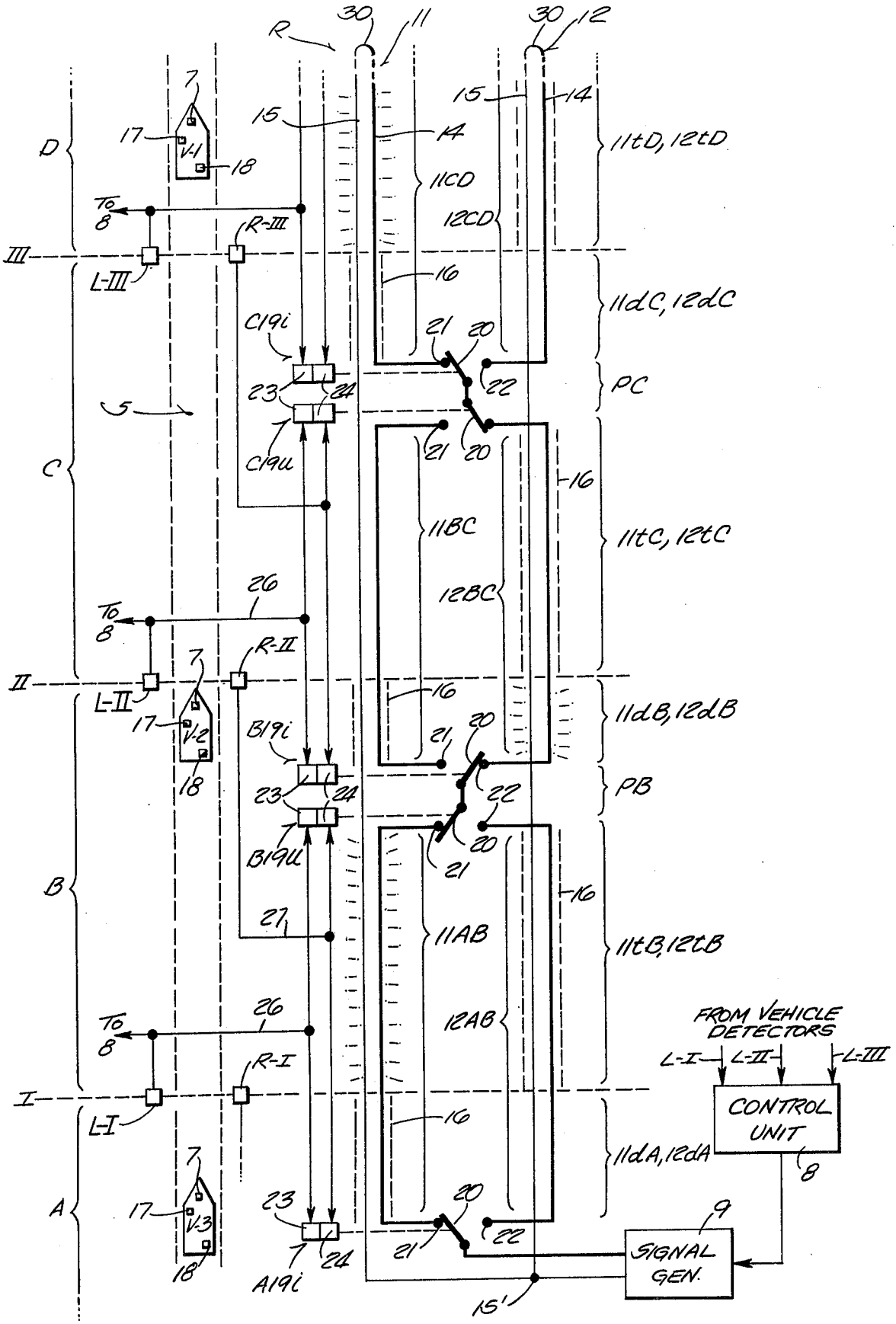
R
30
11
30
12
7
17
V-1
18
D
15
14
11tD, 12tD
11CD
12CD
To 8
R-III
III
L-III
16
11dC, 12dC
C19i
21
20
22
PC
23
24
5
C19u
C
11BC
12BC
11tC, 12tC
26
To 8
R-II
II
L-II
V-2
B19i
11dB, 12dB
PB
B19u
B
27
11AB
12AB
11tB, 12tB
26
To 8
R-I
I
L-I
11dA, 12dA
A
V-3
A19i
15'
FROM VEHICLE DETECTORS
L-I
L-II
L-III
CONTROL UNIT
8
9
SIGNAL GEN.

FAIL-SAFE SEPARATION OF DRIVERLESS VEHICLES

This invention relates to apparatus for the control of driverless vehicles that travel in one direction along a defined path and receive command signals from a central control unit; and the invention is more particularly concerned with fail-safe apparatus that is actuated by the vehicles themselves to maintain a predetermined minimum separation between successive vehicles along the path.

The type of system to which the invention relates is one in which driverless vehicles are controlled by means of radiations from elongated radiator means extending all along a path traversed by the vehicles and from which radiations are propagated in the form of signals that constitute encoded commands to the several vehicles. The vehicles may be confined to the path by means of a rail or rails; or the radiator means can comprise a cable or the like, and the vehicles may steer themselves automatically along it by sensing the radiations from it. In either case, the command signals transmitted to the vehicles control such of their functions as speed of travel, opening and closing of doors, and the like.

Various systems have been devised for issuing command signals to driverless vehicles in such a manner that a specific command signal can be addressed to a particular vehicle, to enable every vehicle to be controlled individually. However, with any such system the positions of the several vehicles along the path must be constantly monitored, so that appropriate command signals will be transmitted to each vehicle, and provision should be made for so controlling every vehicle that safe separation intervals are at all times maintained between successive vehicles. In theory, interval control can be delegated to a central control unit which comprises data processing apparatus programmed for interval maintenance as well as for the several other control functions that must be directed. However, assigning interval control to such a control unit necessarily complicates both the data processing apparatus and its programming and has the more important disadvantage of not affording a failsafe type of control.

A better system from the safety standpoint, in that it failed safe, was disclosed in U.S. Pat. No. 3,848,836, to Wallgard et al. In that system the vehicle path was divided lengthwise into blocks, and the radiator was lengthwise divided into discrete elements that were endwise adjacent to one another, with several such radiator elements per block. Command signals directed to a particular vehicle were impressed only upon the radiator element to which that vehicle was proximate, so that only it could receive such signals. In addition, each vehicle could move only while it was receiving command signals at regular intervals. By means of an arrangement of vehicle detectors located at the block boundaries, cooperating with bistable switching devices associated with certain of the radiator elements, a vehicle crossing a block boundary caused the radiator element immediately behind that boundary to be disconnected from the signal generator, to prevent a following vehicle from approaching that block boundary. As a vehicle left a block, the connection between the signal generator and the radiator element just behind that block was restored, to permit a following vehicle to enter the vacated block.

With the system of that patent, maintenance of distance intervals, instead of being assigned to a central control unit, was controlled by the vehicles themselves, in consequence of their passage of block boundaries. However, if command signals were to be issued to the vehicles from a central control unit, there had to be a separate connection between each radiator element and the central control unit, to enable command signals addressed to a particular vehicle to be impressed only upon the radiator element nearest that vehicle. For centralized control of vehicle functions, implementation of that system was therefore expensive because of the need for separate conductor leads running from the central unit to each of the radiator elements, together with more or less complicated switching equipment at the central unit to provide for discrete energization of the several radiator elements.

By contrast, it is a general object of the present invention to provide a fail-safe system for maintenance of separation between driverless vehicles, based upon local block logic and controlled by the vehicles themselves, which system also provides for centralized control of other functions of the vehicles individually, without the need for complicated apparatus or expensive plant for effectuating such individualized vehicle control.

Another and more specific object is to provide a fail-safe system for control of driverless vehicles wherein command signals for the control of all vehicles can be impressed upon radiator means extending all along a path traversed by the vehicles, every command signal being impressed upon the radiator means along its entire length and each command signal being coded to signify an operation to be executed by a particular vehicle and an address that identifies the particular vehicle which is to perform that function, and the command signals addressed to the several vehicles being sent in a regular sequence so that each vehicle receives reiterated command signals; but wherein local traffic conditions can pre-empt command signals to determine whether or not a vehicle can progress along the path.

It is also a specific object of the invention to provide a simple and inexpensive block control system for driverless vehicles that move in one direction along a path that is divided into lengthwise adjacent blocks, whereby each vehicle, as it enters a block, sets up a condition such that a following vehicle cannot approach the entrance boundary to that block until the block is vacated, and wherein vehicle detectors that are located at the block boundaries respond to each crossing of such a boundary by a vehicle to produce an output which sets up the condition just mentioned and which can also serve as an input to a central control unit that enables the unit to monitor the positions of the several vehicles along the path.

With these observations and objectives in mind, the manner in which the invention achieves its purpose will be appreciated from the following description and the accompanying drawing, which exemplify the invention, it being understood that changes may be made in the specific apparatus disclosed herein without departing from the essentials of the invention set forth in the appended claims.

The accompanying drawing illustrates one complete example of an embodiment of the invention constructed according to the best mode so far devised for the practical application of the principles thereof, and in which:

The single FIGURE is a diagrammatic view of a driverless vehicle control system embodying the principles of this invention.

Referring now to the accompanying drawing, the numeral 5 designates a portion of an elongated path along which driverless vehicles move and which may be defined in any of several ways, as for example by a rail or rails or by a roadway along which vehicles are guided by means of a sensing system such as is described in U.S. Pat. No. 3,811,112,to J. B. Hoven et al.

The path 5 is intended to be traversed by several vehicles simultaneously, all of them moving in the same direction and maintaned at safe separation intervals by the control system of this invention. Three such vehicles are illustrated diagrammatically, designated V-1, V-2 and V-3, and their direction of travel is assumed to be upwardly on the drawing. For control of lengthwise spacing of the vehicles, the path 5 is divided into lengthwise adjacent blocks, four of which are denoted A, B, C, D. Inasmuch as the system of this invention serves to prevent a vehicle from entering a block occupied by another vehicle, the length of each block is at least equal to the minimum safe distance between successive vehicles along the path 5.

The boundary between blocks A and B is denoted by I, between blocks B and C by II, and between blocks C and D by III. Having regard to the direction of vehicle travel, the boundary I can be considered an exit boundary for block A and an entry boundary for block B, the boundary II is an exit boundary for block B and an entry boundary for block C, etc.

Command signals for controlling various functions of the vehicle other than its steering are issued to each vehicle by radiation from electrically conducting radiator means, designated generally by R, extending lengthwise all along the path 5. According to the invention, the radiator means has certain novel features that are explained in detail hereinafter; but both the radiator means and the system of radiation employed therewith are conventional in the respect that the radiated signals are detectable at no more than a relatively limited distance from the radiator means and that radiation is propagated in consequence of energization of the radiator means with a suitable electric current. Typically, the command signals can be encoded in low frequency electromagnetic radiation, but other types of radiation can be employed. Detector apparatus 7 in each vehicle, preferably mounted at the front thereof, detects the radiated signals and comprises means for decoding the signals and for causing the vehicle to execute the proper responses to the commands signified by them.

The instructions signified by the command signals relate to such vehicle functions as speed to be maintained and operation of doors, lights and other vehicle systems. Although steering instructions as such will not normally be encoded in the command signals, the radiations in which the command signals are encoded may be sensed for steering purposes, and the radiator means R can accordingly be laid lengthwise within the path 5 to enable it to be used for such steering guidance, as explained in the above mentioned Hoven et al and Wallgard et al patents.

The command signals are sent in succession, each addressed to a different predetermined one of the vehicles, and each such command signal will of course include an encoded address signifying the particular vehicle for which it is intended. It will be understood that the detector 7 in each vehicle comprises decoding means rendering the vehicle responsive only to those command signals that include the particular coded address for that vehicle. Assuming — as will normally be the case — that command signals addressed to the different vehicles will be transmitted in a regular sequence, each vehicle will receive signals addressed to it at regular intervals.

In accordance with the invention, the detector apparatus 7 permits the vehicle to continue in forward movement only so long as command signals are being received at the vehicle. The command signals utilized for the purpose of this fail-safe function can be either those that are addressed to the particular vehicle or command signals generally. Various expedients for implementing either arrangement are known or will be readily apparent to those skilled in the art.

The encoding of the command signals is effected by means of a control unit 8 that can comprise data processing equipment programmed to maintain a predetermined schedule of operations of the vehicles. The signals themselves are generated by means of a signal generator 9 operating under control of the control unit 8 and which feeds into the radiator means R. The control unit receives inputs that denote the crossing of block boundaries by the vehicles, which inputs are issued by at least one of each of a pair of vehicle detectors L-I and R-I, L-II and R-II, and L-III and R-III that are located at each block boundary and perform certain further functions explained below. It will be understood that if the vehicles run on rails, track circuits could be employed for vehicle detection, and the term "vehicle detector means" is therefore used herein to denote any expedient for producing an output in response to the proximity of a vehicle.

Turning now to a more detailed consideration of the radiator means R, it is arranged, in general, in two laterally adjacent stretches 11 and 12, each of which extends substantially the full length of the path 5. Although shown otherwise for clarity, the two stretches are both so close to the path 5 laterally that short range radiation from each of them can be detected by vehicles in the path but not by those in another adjacent path. Each stretch comprises two conductors 14 and 15 which, however, are connected with one another at their ends remote from the signal generator 9, as indicated at 30, so that each stretch is capable of comprising a complete radiator loop. In each stretch, the conductor 14 constitutes a "hot" conductor that is broken into sections as explained hereinafter, while the conductor 15 comprises a return conductor which can be continuous and unbroken along the length of the path 5 or can be broken into stretches corresponding to those of the conductor 14, depending upon the type of radiator employed. As shown, the return conductors 15 of the respective stretches 11 and 12 are connected in parallel with one another as at 15'. The conductors 14 are shown in heavier lines than the conductors 15 merely to facilitate understandng of the drawing, it being understood that the two conductors 14 and 15 can in practice be identical.

Although both conductors 14 and 15 of each stretch may be broken into sections, for simplicity only the conductor 14 is illustrated as so broken. Whatever arrangement is used will have the effect of dividing each stretch of the whole radiator into the radiator sections now to be described. The several illustrated sections of the stretch 11 are designated by 11AB, 11BC and 11CD while those of the stretch 12 are designated 12AB, 12BC and 12CD. Each section has a length roughly equal to that of a block, but the radiator sections are not coextensive with the blocks; instead, each section extends across a block boundary. However, each section of one stretch is coextensive with a paired section of the other stretch (e.g., section 11AB of stretch 11 is coextensive with its paired section 12AB of stretch 12).

The terminii of the several radiator sections are at control points PB, PC at which electrical switching occurs between various sections of the conductor 14, as explained below. Although illustrated otherwise for purposes of clarity, each of the control points has negligible length along the path 5. Each control point is preferably located nearer to the exit boundary of its block than to the entry boundary thereof.

For each section, the control points between which the section extends cooperate with the block boundary across which it extends to define two segments, one of them a relatively short departure segment, the other a longer traverse segment. The departure segment of each section lies to the rear of its traverse segment, relative to the direction of vehicle travel. The departure segments of paired sections 11BC and 12BC are designated 11dB and 12dB, respectively, and they extend through a short portion of block B, from control point PB to the exit boundary II of block B. The departure segments of paired sections 11CB and 12CD are respectively designated 11dC and 12dC. The traverse segments of paired sections 11AB and 12AB are respectively designated 11tB and 12tB; and they extend along a major portion of the length of block B from the entry boundary I thereof to control point PB. The traverse segments of paired sections 11BC and 12BC are respectively designated 11tC and 12tC.

In the stretch 11, each section 11AB, 11BC, 11CD has its departure segment 11dA, 11dB, 11dC, respectively, effectively shielded so that no radiation can reach a vehicle detector as a result of current flow through that radiator section. For simplicity, shielding of those segments is denoted by 16, and while such effective shielding can comprise a radiation-proof screen that surrounds the conductor pair, an effectively shielded segment could be otherwise prevented from effectually radiating, as by twisting the conductor pair 14–15 in the case of inductive transmission. The remainder of each of the radiator sections 11Ab, 11BC and 11CD, comprising the respective traverse segments 11tB, 11tC, 11tD, is left unshielded and capable of propagating radiation in consequence of current flow through its conductors.

Conversely, in each section 12AB, 12BC, 12CD of the stretch 12, the departure segment 12dA, 12dB, 12dC is left unshielded and capable of radiating signals, while the traverse segment 12tB, 12tC, 12tD is shielded to be incapable of radiating.

It will now be apparent that for a vehicle to approach closely to a block boundary, it must receive a steady succession of command signals radiated from the unshielded departure segment of a laterally adjacent section of the stretch 12; but to progress through the major portion of the block beyond that boundary it must constantly receive command signals from its laterally adjacent unshielded traverse segment of the stretch 11. The sections of stretch 12 can therefore be considered as approach sections while their paired sections in stretch 11 can be considered cruise sections. According to the principles of the present invention, only one or the other of a radiator section pair (e.g. 11AB or 12AB) can be energized at any one time, and therefore the energizing current must be switched from an approach section to its paired cruise section at the time a vehicle crosses the block boundary across which they extend, in order for the vehicle to continue in motion beyond the boundary. The necessary switching is effected by the vehicles themselves, in consequence of their passage across block boundaries, and is accomplished in such a manner that each vehicle prevents a following vehicle from entering a block that it occupies.

To enable the vehicles to effect the necessary switching operations, each vehicle is equipped with a pair of exciters 17 and 18, the exciter 17 being located on one side of the vehicle, preferably near its front end, and the exciter 18 being mounted on the opposite side, preferably near the rear end of the vehicle. These exciters cooperate with the vehicle detectors L-I, R-I, L-II, R-II . . . etc., located at the block boundaries, there being one vehicle detector at each side of the path at each block boundary. Thus the pair of vehicle detectors L-I and R-I is located at the boundary I those designated L-II and R-II are located at boundary II, etc. The left-hand vehicle detectors L-I, L-II, etc. respond to the left-hand exciter 17 on each vehicle; the right-hand detectors R-I, R-II, etc. respond to the right-hand detectors 18. Each vehicle detector produces a brief output when a vehicle passes it. and it will be noted that, at each boundary, the left-hand detector is excited shortly before the right-hand one.

As mentioned above, at least one vehicle detector of each pair can have a connection with the control unit 8 whereby signals are sent to the control unit that denote passage of the respective boundaries by the vehicles. In addition, the vehicle detectors are connected with certain bistable switching devices A19i, B19u, B19i, C19u, C19i, which control energization of the several radiator sections. The switching devices are illustrated as relays, each comprising a pair of windings 23, 24 which are adapted to be momentarily energized by the outputs from the vehicle detectors and which control the position of a movable contactor 20 that is cooperable with a pair of fixed contacts 22, 22. It will be understood that if the left-hand winding 23 of a switching device is momentarily energized, the movable contactor 20 of that switching device swings into engagement with its cooperating fixed contact 21 and remains so engaged until the right-hand winding 24 of that same device is momentarily energized, whereupon the movable contactor assumes its other stable condition in engagement with the fixed contact 22. Obviously, electronic switching devices, comprising, for example, bistable flip-flops, could be employed instead of the electromechanical switching devices here illustrated; and it will be understood that the bistable switchng devices — of whatever character — could be controlled by track circuits or by other types of vehicle detector means than those specifically described hereinabove.

Effectively, the bistable switching devices are located at the control points PB, PC within the respective blocks B, C; and there are a pair of such switching devices at each control point, designated (for control point PB) AS B19u and B19i, and (for control point PC) as C19u and C19i. Note that the switching devices designated by B19u and C19u are output switches associated with terminals at the departure ends of radiator sections, while switching devices B19i and C19i are input switches associated with the entry ends of sections. The two switching devices at each control point have their movable contactors 20 connected with one another, and each has one of its fixed contacts 21 connected with a section of conductor 14 that is in the stretch 11 while its other fixed contact 22 is connected with the paired section of conductor 14 that is in the stretch 12.

The left-hand detector L-I, L-II, L-III at each block boundary is connected by means of a branched conductor 26 with the winding 23 of the input switching device immediately to the rear of that boundary (relative to the direction of vehicle travel) and also with the winding 23 of the output switching device next forward of that boundary. The right-hand detector R-I, R-II, R-III at each block boundary is connected by means of a branched conductor 27 with the winding 24 of the output switching device rearwardly nearest its boundary and also with the windng 24 of the input switching device that is rearwardly nearest the next preceding block boundary.

The operation of the system is readily understood with reference to the illustrated example, wherein the vehicle V-1 has just crossed boundary III and has begun to traverse block D, block C is unoccupied, vehicle V-2 is in the departure portion of block B and is approaching boundary II, and vehicle V-3 is in the departure portion of block A.

When it crossed boundary III, vehicle V-1 caused momentary outputs to be issued by vehicle detectors L-III and R-III. These outputs informed the central control unit that block C was now vacant and block D occupied, and sent actuating signals to swtiching devices C19i, C19u and B19i. (It will be understood that an actuating ouput was also sent to an output switch not shown in the FIGURE, located at a control point ahead of vehicle V-1.) The output from detector L-III to windng 23 of switching device C19i shifted the contactor 20 of that input switch to the position shown, in which cruise section 11CD is energized with signal current to enable vehicle V-1 to traverse the major portion of block D under control of signals radiated from unshielded traverse segment 11tD. The output from detector R-III to windng 24 of switch device C19u shifted the contactor 20 of that ouput switch to the position shown, in which it completes a connection between cruise section 11CD and now-energized approach section 12BC. Finally, the output from vehicle detector R-III to winding 24 of switch device B19i provided for energization of approach section 12BC.

Until vehicle V-1 had crossed boundary III, cruise section 11BC was energized, and because the departure segment 11dB of that section is shielded, vehicle V-2 could not advance much beyond control point PB until block C was vacated. However, under the conditions illustrated, vehicle V-2 can of course proceed from point PB to boundary II under the influence of radiation from unshielded radiator segment 12dB.

When it passed block boundary I, vehicle V-2, in cooperation with vehicle detectors L-I and R-I, had caused input switching device A19i to assume the condition illustrated, whereby vehicle V-2 was enabled to traverse most of the length of block B in response to radiation from unshielded radiator segment 11tB. At the same time, however, the shielding 16 on segment 11dA prevented any radiation from beng transmitted to a vehicle in the departure portion of block A. This is to say that so long as block B is occupied by vehicle V-2, vehicle V-3 cannot aproach the entry boundary I of that block. Of course as vehicle V-2 crosses boundary II, its exciter 17 will first cause detector L-II to produce an output, and a short moment later its exciter 18 will stimulate an output from detector R-II.

The output from detector L-II will shift input switch B19i to its condition opposite that shown, so that cruise section 11BC will be energized to allow vehicle V-2 to traverse block C up to control point PC; and that detector output will simultaneously shift output switch device C19u to its condition opposite that shown, to enable the appropriate one of paired sections 11CD and 12CD to be energized from then-conducting radiator section 11BC. Note that with section 11BC energized (to the exclusion of its paired section 12BC) a following vehicle will be unable to approach closely to boundary II.

The output from vehicle detector R-II will cause input switch A19i to be shifted to its condition opposite the one shown, so that approach secion 12AB is energized to enable vehicle V-3 to move all the way to boundary I under the influence of radiation propagated from unshielded segments 12dA. Simultaneously, output switch B19u will be shifted to its condition opposite the one shown, to enable then-conducting section 11BC to receive current from then-conducting section 12AB.

In summary, when a vehicle crosses a block boundary and enters a new block, the invention so functions as to prevent a following vehicle from approaching to within a predetermined distance of the boundary thus crossed, but enables a vehicle in a block directly behind the one just vacated to move into the vacated block. It will be apparent that in the event of failure of a vehicle detector or a switch device, vehicles behind the point at which failure has occurred will be stopped rather than being allowed to proceed, and in that respect the system as a whole fails safe.

It will be evident that with proper crossovers or transpositions of the stretches 11 and 12 at the several control points and block boundaries, the several section segments that are unshielded could all be laid in the path 5, or closely adjacent thereto, while the several effectively shielded segments could be located at some substantial distance laterally from the path. In that case actual shielding of the remotely located segments would not be necessary, for even though those segments would in fact be radiating, they would be effectively shielded, as that term is used herein, inasmuch as their radiations would not reach vehicles in the path.

From the foregoing description taken with the accompanying drawing it will be apparent that this invention provides a block logic control system for driverless vehicles that requires relatively simple and inexpensive radiator means, is well adapted for centralized control of vehicle operations, and provides effective block control of traffic in response to passage of the vehicles across block boundaries, being capable of pre-empting command signals to the vehicles when local traffic conditions warrant doing so, and having the further very important advantage that it fails safe.

Those skilled in the art will appreciate that the invention can be embodied in forms other than as herein disclosed for purposes of illustration. The invention is defined by the following claims:

We claim:

1. A control system for a plurality of remotely controlled vehicles traveling in one direction along a defined path that is divided into longitudinally adjacent blocks, each block having an entry boundary which a vehicle crosses upon entering that block and an exit boundary which the vehicle crosses upon entering the next block in said direction, said control system being of the type comprising electrically conducting radiator means extending lengthwise substantially all along said path, means for energizing said radiator means with an electric current that tends to cause short range radiation to propagate from the radiator means energized thereby and enables successive commands to the vehicles to be encoded in such radiation, and detector means on each vehicle responsive to such radiation and operative to enable movement of the vehicle only so long as radiation is being detected at the vehicle, said control system being characterized by:

A. the radiator means being arranged in a pair of laterally adjacent stretches, each of which extends substantially the full length of the path, B. each of said stretches being effectively divided into a plurality of sections;

1. each section extending in one direction from a point in one block that is spaced from the boundaries of that block to a corresponding point in the next block in said direction,
2. each section of one stretch being substantially coterminous with a section of the other stretch that is paired with it, the sections of each pair being alternatively energizable, and
3. each section being capable of conducting current all along its length;

C. each section of one of said stretches being a cruise section having an effectively shielded segment that extends from said point in a block to the exit boundary of that block, the remainder of the section being capable of propagating radiation upon current flow therethrough;

D. each section of the other stretch being an approach section having an effectively shielded segment that extends from the entry boundary of a block to said point in that block, but being otherwise capable of propagating radiation upon current flow therethrough;

E. vehicle detector means at each block boundary for producing a momentary output in response to passage of a vehicle across the boundary; and F. means responsive to outputs from said vehicle detector means for so energizing one of each pair of sections, by connection with the energized one of the next preceding pair of sections relative to said direction of travel, as to prevent a vehicle from approaching the entrance boundary of a block occupied by another vehicle, the last mentioned means comprising bistable switching means.

2. The control system of claim 1 wherein said bistable switching means comprises:

1. a bistable input switch for each section pair, having conditions for selective and alternative connection with either the cruise section or the approach section of its section pair at their ends first approached by a vehicle traveling in said direction, to provide for energization of a selected one of the paired sections; and
2. a bistable output switch for each section pair, having conditions for selective and alternative connection with either the cruise section or the approach section of its section pair at their opposite ends, the output switch for each pair of sections being at all times connected with the input switch for the next adjacent pair of sections in the direction of vehicle travel so that the several input and output switches cooperate to energize one section of every pair along the length of the radiator means.

3. The control system of claim 2, wherein said vehicle detector means at each boundary comprises first and second output devices, each of which produces an output in response to passage of a vehicle across its boundary, further characterized by:

1. means providing a connection between the first output device at each boundary and both switches for the pair of sections extending across said boundary, said connection being so arranged that in response to an output from said first output device said both switches assume their conditions for connection with the cruise section of their pair of sections; and
2. means providing a connection between the second output device at each boundary and both switches for the pair of sections that extends across the next preceding boundary in the direction of vehicle travel, the last mentioned connection being so arranged that in response to an output from said second output device the last mentioned both switches assume their conditions for connection with the approach section of their section pair.

4. A control system for a plurality of remotely controlled vehicles traveling in one direction along a defined path that is divided into longitudinally adjacent blocks, each block having an entry boundary which a vehicle crosses upon entering that block and an exit boundary which the vehicle crosses upon entering the next block in said direction, said control system being of the type comprising electrically conducting radiator means extending lengthwise substantially all along said path, means for energizing said radiator means with an electric current that tends to cause short range radiation to emanate from the energized radiator means and enables successive commands to the vehicles to be encoded in such radiation, and detector means on each vehicle responsive to such radiation and operative to enable movement of the vehicle only so long as radiation is being detected at the vehicle, said control system being characterized by:

A. the radiator means being arranged in pairs of sections, the sections of each pair being laterally adjacent to one another and each pair of sections being lengthwise adjacent to at least one other pair of sections, 1. the two sections of each pair being selectively and alternatively energizable and respectively comprising
   a. a cruise section and
   b. an approach section,
2. each section having a length on the order of that of a block and extending across a block boundary, both sections of each pair extending
   a. from a point in one block that is spaced a substantial distance from both of its boundaries
   b. to a correspondng point in the next adjacent block in said direction;

B. the cruise section of each pair of sections being effectively shielded between said point in a block and the exit boundary of that block, but being otherwise capable of effective radiation upon current flow therethrough;

C. the approach section of each pair of sections being effectively shielded between the entry boundary of a block and said corresponding point in that block, but being otherwise capable of effective radiation;

D. a pair of bistable switch means for each pair of sections, 1. one of said bistable swtich means being selectively and alternatively connectable with the sections of its pair at the ends thereof first approached by a vehicle and comprising input switch means,
2. the other of said bistable switch means being similarly connectable with the sections of its pair at the other end thereof and comprising output switch means, and
3. the output switch means for each pair of sections being connected with the input switch means for the pair of sections next adjacent in said direction;

E. vehicle detector means for each block boundary, responsive to passage of a vehicle across said block boundary to produce outputs for controlling the conditions of bistable switch means; and F. means so connecting the vehicle detector means for each block boundary with the bistable switch means for the section pair extending across that boundary and for the section pair extending across the next preceding boundary relative to said direction that passage of a vehicle across a block boundary effects energization of 1. the cruise section of the section pair extending across the boundary crossed by the vehicle and
2. the approach section of the section pair that extends across the next preceding boundary in said direction.

5. The control system of claim 4 wherein said point in each block is substantially nearer to the exit boundary of the block than to its entry boundary.

* * * * *